US006670536B2

(12) United States Patent
Godin et al.

(10) Patent No.: US 6,670,536 B2
(45) Date of Patent: Dec. 30, 2003

(54) MUSICAL INSTRUMENT CASE

(75) Inventors: Robert Godin, Vaudreuil-sur-le-lac (CA); Claude Lussier, Notre-Dame-de-l'Ile-Perrot (CA); Martin Leduc, St-Lazare (CA); Richard Bourbonnais, Pointe-Claire (CA)

(73) Assignee: Lasido Inc., Baie d'Urfé (CA)

( * ) Notice: Subject to any disclaimer, the term of this patent is extended or adjusted under 35 U.S.C. 154(b) by 0 days.

(21) Appl. No.: 09/906,665

(22) Filed: Jul. 18, 2001

(65) Prior Publication Data

US 2003/0015083 A1 Jan. 23, 2003

(51) Int. Cl.[7] ..... G10G 7/02
(52) U.S. Cl. ..... 84/453; 206/314
(58) Field of Search ..... 84/453, 327, 280; 206/314, 14

(56) References Cited

U.S. PATENT DOCUMENTS

| | | | | |
|---|---|---|---|---|
| 1,855,232 A | | 4/1932 | Gulick | |
| 1,986,393 A | | 1/1935 | Geib | |
| 2,627,887 A | | 2/1953 | Becker | |
| 3,181,693 A | | 5/1965 | Freistat | |
| 3,901,384 A | | 8/1975 | Lee et al. | |
| 4,147,254 A | | 4/1979 | Bruce | |
| 4,190,152 A | * | 2/1980 | Reiter | 206/314 |
| 4,225,041 A | | 9/1980 | Lorenzini | |
| 4,427,113 A | | 1/1984 | Wanner | |
| 4,531,632 A | | 7/1985 | Weber | |
| 4,884,487 A | | 12/1989 | Feldkamp | |
| 5,002,184 A | | 3/1991 | Lloyd | |
| 5,219,075 A | * | 6/1993 | White | 150/162 |
| 5,520,462 A | | 5/1996 | Clark | |
| 5,713,465 A | * | 2/1998 | Choe | 206/314 |
| 5,816,395 A | | 10/1998 | Dougherty | |
| 5,833,051 A | | 11/1998 | Tiefenbrun et al. | |
| 5,918,785 A | | 7/1999 | Irose | |
| 6,029,804 A | | 2/2000 | Flynn | |
| 6,172,292 B1 | | 1/2001 | Dimbath | |
| 6,446,809 B2 | * | 9/2002 | Flynn | 206/523 |

* cited by examiner

*Primary Examiner*—Kimberly Lockett
(74) *Attorney, Agent, or Firm*—Goudreau Gage Dubuc

(57) ABSTRACT

A musical instrument case made of foam material is described herein. The case is advantageously made of rigid foam material, such as, for example polypropylene foam, that has been molded to the desired musical instrument shape. In the case of a stringed instrument the body and cover portions of the case, both made of polypropylene foam, are joined by hinges partially embedded in the foam material. The body and cover portions meeting edges are preferably provided with complementary channel and tongue assemblies increasing the structural stability of the case, once closed.

19 Claims, 5 Drawing Sheets

MUSICAL INSTRUMENT CASE

FIELD OF THE INVENTION

The present invention relates to protection cases. More specifically, the present invention is concerned with a musical instrument case.

BACKGROUND OF THE INVENTION

Musical instrument cases are widely used to store, protect and/or carry musical instruments. For example, in the case of stringed musical instruments such as guitars, the cases are usually constructed according to the structure illustrated in a sectional view in FIG. 1.

FIG. 1 illustrates a multi-layer structure of different materials forming a conventional guitar case 10. First, the structure of the case 10 is ensured by a wood material layer 12 which may be, for example, plywood. This wood material layer 12 is covered with an external layer 14, for example made of leather, or other weather resistant material. This layer 14 is required since the wood layer 12 cannot adequately protect the instrument against adverse weather conditions. It is also usually preferable for aesthetic purposes.

Internally, the conventional guitar case includes a relatively soft foam layer 16 entirely covering the internal surface of the wood layer 12 to protect the instrument when the case is moved. A final soft fabric layer 18 is provided to entirely cover the foam layer so as to protect the relatively weak foam and to provide an improved internal case aesthetic.

As will be understood by one skilled in the art, the production of a guitar case using a multi-layer structure as described hereinabove is very labour intensive and therefore yields a relatively expensive case.

Furthermore, the use of a wood material layer increases the weight of the finished musical instrument case and complexities the construction since the shape of the case must generally conform to the shape of the musical instrument and wood material is not particularly well suited for such rounded shapes in an industrial setting.

OBJECTS OF THE INVENTION

An object of the present invention is therefore to provide an improved musical instrument case.

SUMMARY OF THE INVENTION

More specifically, in accordance with the present invention, there is provided a musical instrument case comprising:

- a body made of rigid foam material; the body defining an outer surface and an inner surface; and
- a cover made of rigid foam material; the cover being hingedly mounted to the body so as to be movable between a closed position and an open position; the cover defining an outer surface and an inner surface; wherein both the outer surfaces of the body and the cover define an outer surface of the musical instrument case.

According to another aspect of the present invention, there is provided a musical instrument case comprising:

- a body having an inner surface;
- a cover hingedly mounted to said body so as to be movable between a closed position and an open position; said cover defining having an inner surface; and

- a plurality of padding elements so mounted to said body and cover as to allow a musical instrument to be suspended in said case.

It is to be noted that the expression "rigid foam material" is to be construed herein as any foam material that is sufficiently durable and rigid to be molded to yield a suitable musical instrument case and as any composite of more than one such foam material to obtain the desirable features.

Other objects, advantages and features of the present invention will become more apparent upon reading of the following nonrestrictive description of preferred embodiments thereof, given by way of example only with reference to the accompanying drawings.

DESCRIPTION OF THE PREFERRED EMBODIMENT

Figure 1:
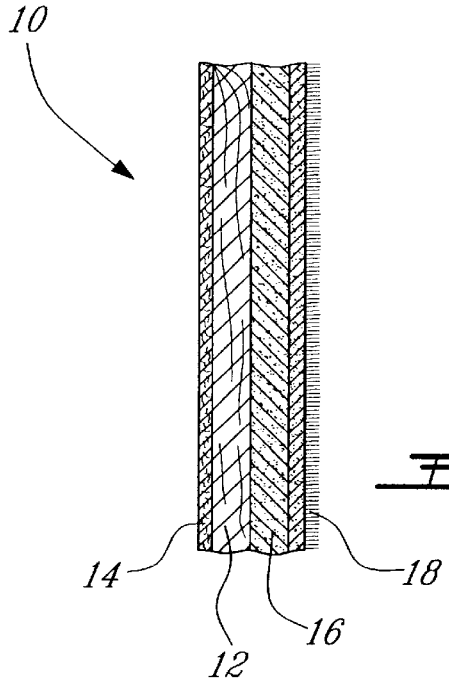
FIG. 1 (PRIOR ART)
FIG. 1, which is labeled "Prior Art" is a sectional view of a multi-layer structure of a conventional musical instrument case.
Figure 2:
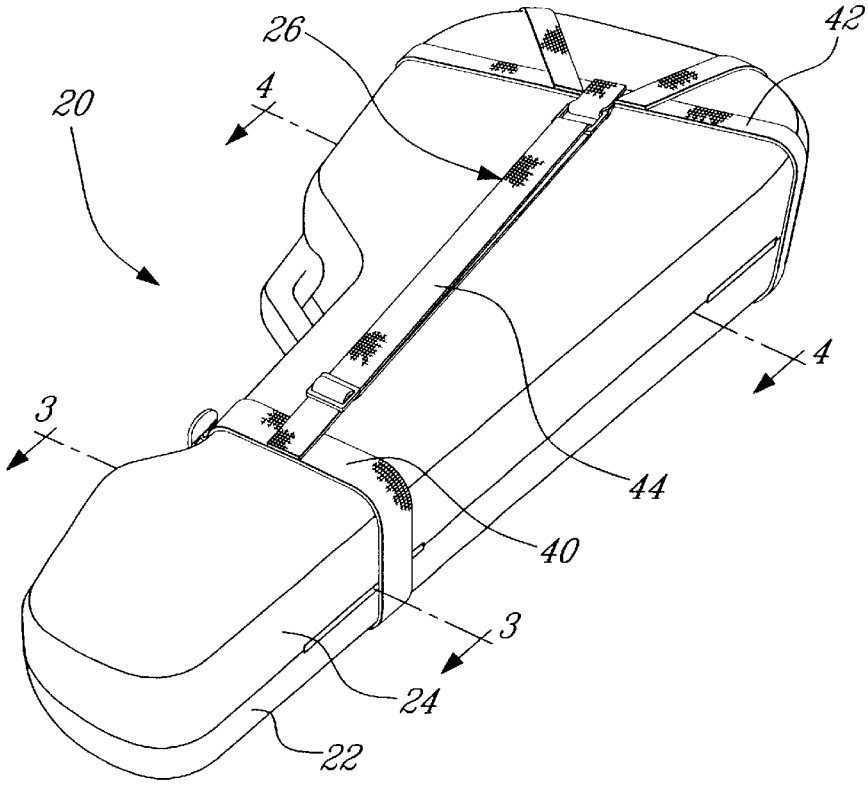
FIG. 2 is a perspective view of a guitar case constructed according to a preferred embodiment of the present invention, shown upside down with the cover in its closed position.

Generally stated a musical instrument case according to the present invention is made of a body and a cover, both made of rigid foam material, such as for example, polypropylene foam, that has been molded so that its internal dimensions are similar to the external dimensions of a musical instrument. By using a rigid foam material to construct the body and the cover, it is possible to forego the required multi-layer structure of the cases of the prior art requiring many construction steps since the outside surface of the body and cover may be used as an outer surface for the case and the inner surfaces of the body and cover may directly receive a musical instrument.

According to another aspect of the musical instrument case of the present invention, a series of padding elements are provided at the periphery of the body and cover to allow the suspension of the instrument within the case so that the most fragile components of the instruments are not in contact with the case.

Turning now to FIGS. 2 to 6, a guitar case 20 according to a first embodiment of the present invention will be described.

The guitar case 20 is made of two main parts, a generally concave body 22 provided with a peripheral edge 23 and a corresponding concave cover 24 provided with a peripheral edge 25. Both parts are made of polypropylene foam. An external securing assembly 26 is provided to keep the cover closed and to help the user to carry the case.

The cover 24 is mounted to the body 22 via two identical hinges 27 and 28. Each hinge is made of plastic and has a double-T profile. Indeed, a first T-shape portion 30 is mounted to the edge 23 of the body and a second T-shape portion 32 is mounted to the edge 25 of the cover 24. A thinner portion 34 is integrally provided between the first and second T-shape portions 30 and 32. As can be better seen from FIG. 3, the first and second T-shape portions 30 and 32 are respectively partially embedded in rectangular depressions in the peripheral edges 23 and 25, respectively.

Figure 3:
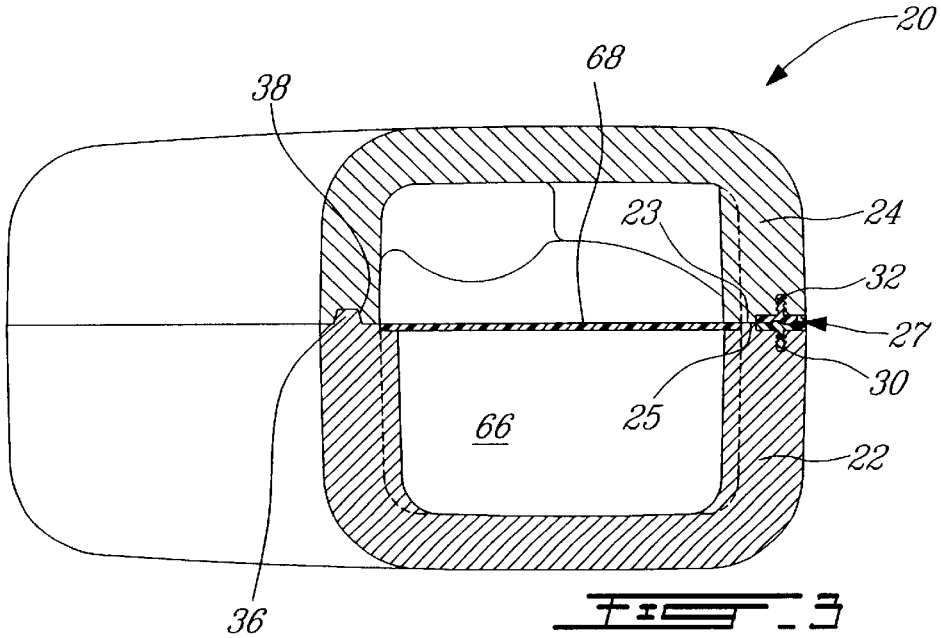
FIG. 3 is a sectional view taken along line 3—3 of FIG. 2.
Figure 4:
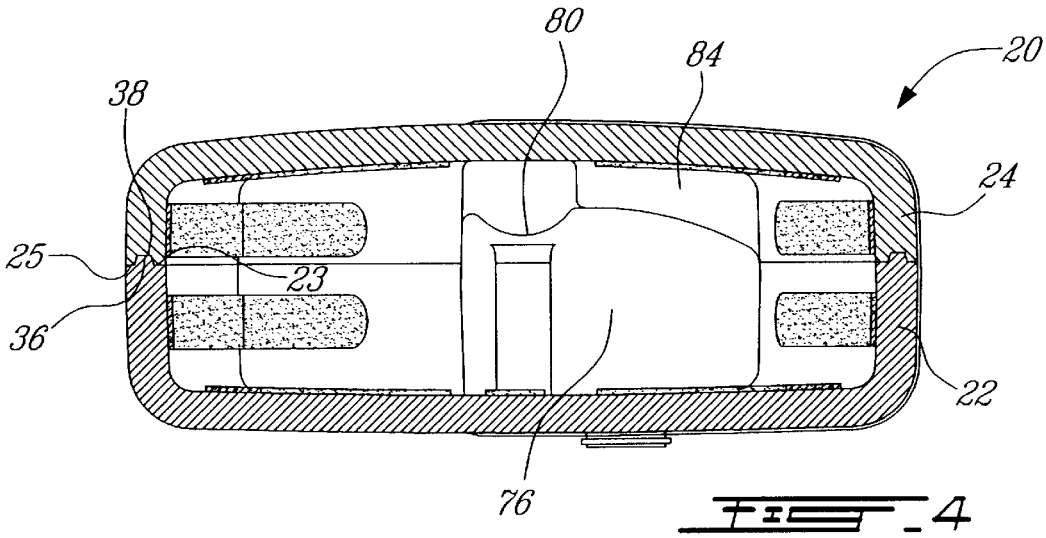
FIG. 4 is a sectional view taken along line 4—4 of FIG. 2.

As can be better seen from FIGS. 3 and 4, the edge 23 of the body 22 is provided with tongues 36 and the edge 25 of the cover 25 is provided with corresponding grooves 38. This tongue and groove arrangement increases the structural integrity of the musical instrument case 20 when it is in the closed position shown in FIGS. 2 to 4. Also it advantageously ensures symetrical positioning of the body 22 and the cover 25 and improves the sealing of the case 20 when it is closed. As can be seen from FIG. 6, the edge 23 is not provided with a tongue on its entire periphery, but has a plurality of tongue portions. Accordingly, the edge 25 is not provided with a groove on its entire periphery, but has a plurality of groove portions.

As discussed hereinabove, an external securing assembly 26 is provided to selectively maintain the case 20 in a closed position. The external securing assembly 26 includes a first neck strap 40 and a second body strap 42, interconnected via an adjustable shoulder strap 44. As can be better seen from FIG. 5, the neck strap 40 includes a ring 46 and a hook and lop portion 48 configured to enter the ring 46 and to maintain the case 20 closed. Similarly, the body strap 42 includes a ring 50 and a hook and lop portion 52 configured to enter the ring 50 and to maintain the case 20 closed. Furthermore, two hook portions 54 and 56 part of the assembly 26 are designed to respectively contact two loop portions 55 and 57 (FIG. 6) secured to the cover 24.

Figure 6:
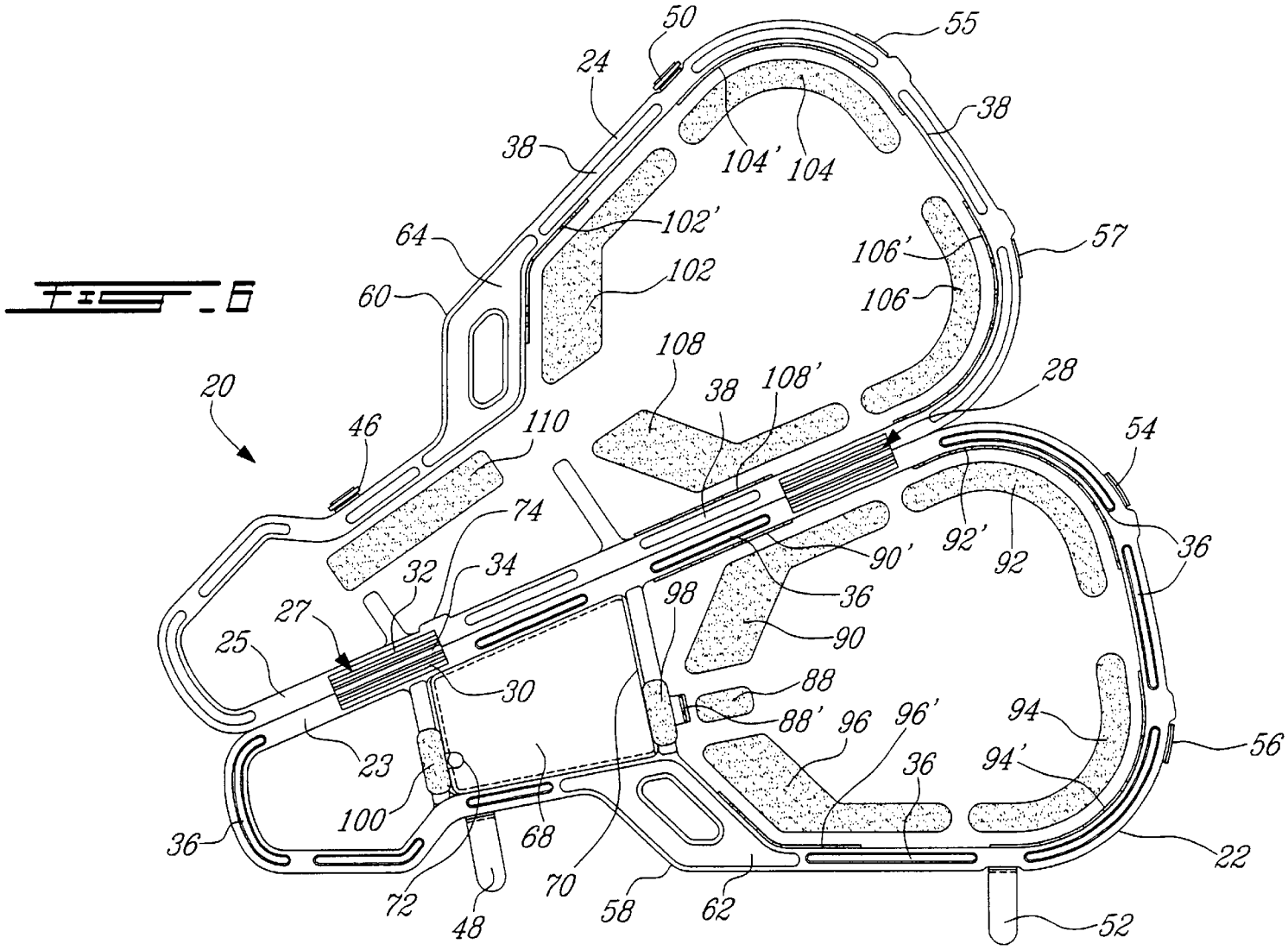
FIG. 6 is a top plan view of the guitar case of FIG. 2 shown in an open position.

Turning now more specifically to FIG. 6, the body and cover 22 and 24 include corresponding handle portions 58 and 60, respectively. These portions form, when the cover is in its closed position, a handle allowing the carrying of the case 20 by a user. As can be seen from this figure, the handle portions 58 and 60 include respective inserts 62 and 64, embedded in the rigid foam material forming the body and cover to strengthen these portions. Indeed, as will be apparent to one skilled in the art, the handle portions are advantageously solidified to prevent premature breakage. The inserts 62 and 64 are advantageously made of a lightweight material such as plastic.

The body 22 of the musical instrument case 20 includes a compartment 66 (see FIG. 3) closed by a compartment cover 68 having a first end 70 hingedly mounted to the body 22 and a second end provided with an aperture 72 to help the user to open the cover 68. The cover 24 is provided with a projection 74 so positioned as to prevent the compartment cover 68 from opening when the cover 24 is in its closed position.

The proximate and distal walls 76 and 78 of the compartment 66 are provided with respective concave depressions 80 and 82 to conventionally receive the neck of the instrument (not shown).

The cover 24 further includes two reinforcing projections 84 and 86 configured, positioned and sized to respectively contact the walls 76 and 78 to improve the structural integrity of the case 20, once closed.

Turning now more specifically to FIG. 6 of the appended drawings, the case 20 also optionally includes discrete padding elements provided in the concave body 22 and in the concave cover 24 to further protect the instrument (not shown) to be placed in the case 20. Indeed, it may be advantageous to strategically place soft padding elements to decrease the contact surface area between the instrument and the case.

More specifically, the body 22 includes five body padding elements 88, 90, 92, 94, and 96, four side padding elements 90', 92', 94' and 96' and two neck padding elements 98 and 100 mounted to the concave depressions 80 and 82, respectively. It is to be noted that the neck padding elements 98 and 100 have been removed from FIG. 5 for clarity purposes.

The cover 24, on the other hand, includes four cover padding elements 102, 104, 106, and 108, four side padding elements 102', 104', 106' and 108', and one neck padding element 110.

Figure 5:
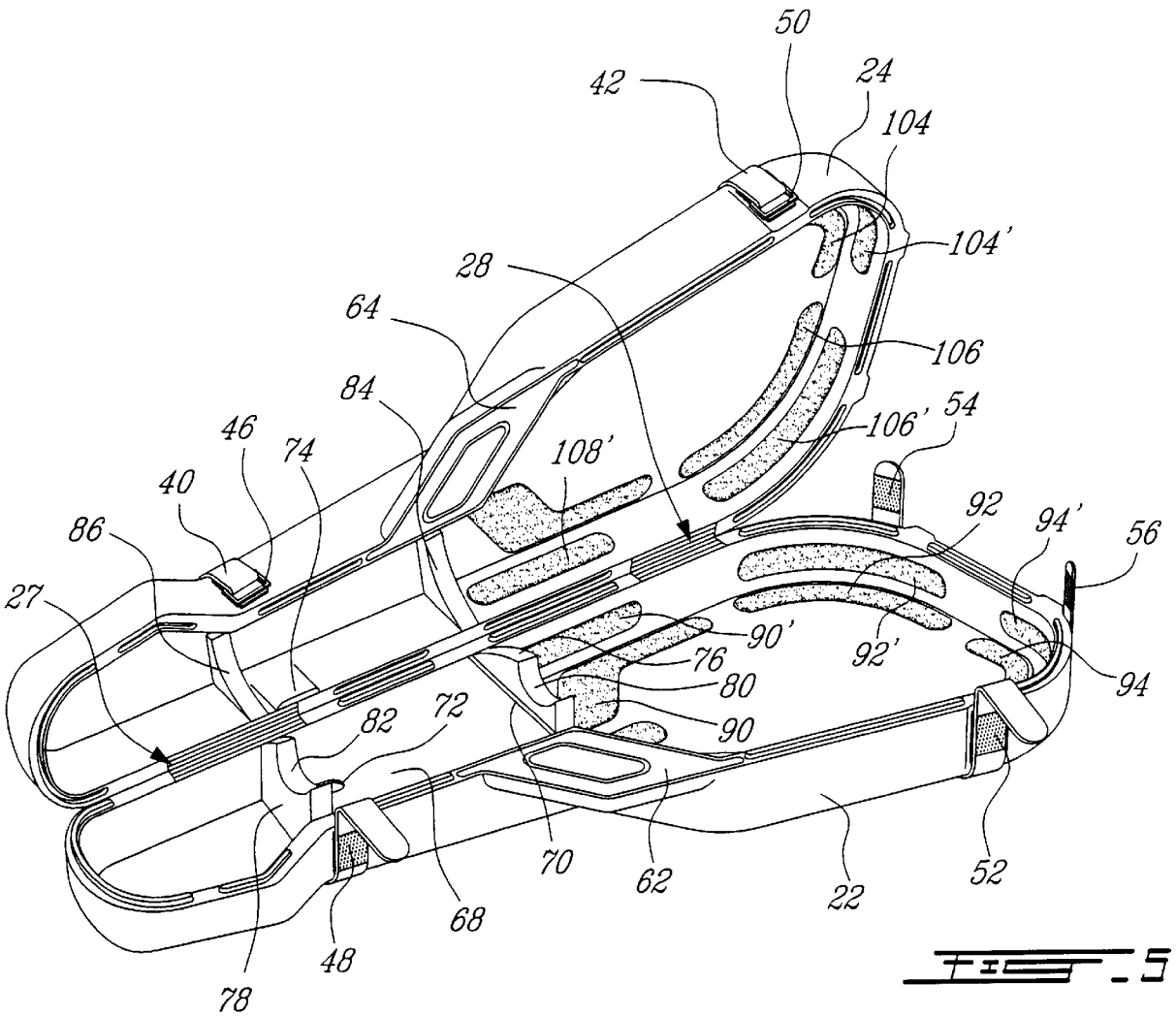
FIG. 5 is a perspective view of the guitar case of FIG. 2, shown with the cover in its open position.

As can be seen on FIGS. 5 and 6, the padding elements 88–108, 90'–96' and 102'–106' are advantageously positioned on the periphery of the body 22 and cover 24 so as to prevent most parts of a guitar being carried in the case 20 from contacting the body 22 and the cover 24. The padding elements 88–108, 90'–96' and 102'–106' allows the carried musical instrument to be suspended in the case 20. Compared to musical instrument cases from the prior art, this offers a better protection for the musical intrument against impact on the case 20. Moreover, it is to be noted that the structural strength of a guitar is greater on its periphery and is also free of parts more keen to break, such as the strings and the soundboard. As illustrated in these Figures, the bottom and side portions of the concave body and cover are provided with padding elements.

The term << suspended >> is therefore to be construed herein and in the appended claims as meaning that the periphery of the object that is suspended is in contact with the case.

The structural composition of the padding elements 88–108, 90'–96' and 102'–106' is so chosen as to be resilient under impact on the case 20 when a musical instrument is carried therein but also as to be sufficiently rigid to prevent impact of the instrument on the case 20 under impact on the case 20.

Each padding element is advantageously multi-layered so as to provide the following additional characteristics: easily mounting in the case 20, resistant and soft contact on the musical instrument.

The following multi-layered structure of the padding elements provides the above-mentionned characteristics: textile fabric laminated on a relatively thick polyether that is laminated on a thinner polyesther foam, and that is finally laminated on a double sided adhesive tape.

The above-described structure is advantageous since the textile fabric brings a nice looking finish on the padding elements and is also more wear resistant than foam, the polyesther foam renders the padding element resilient, the adhesive allows mounting of the padding elements in the body 22 or in the cover 24, while the polyether foam allows adhesion of the tape unto the multi-layered foam structure.

Of course, the nature, composition and density of the padding elements may vary according to the musical instrument that is to be carried in the case 20. The means to mount the padding elements in the case 20 may also vary without departing from the spirit and nature of the present invention. For example, glue or rivet embedded in the padding element may also be used.

Figure 7:
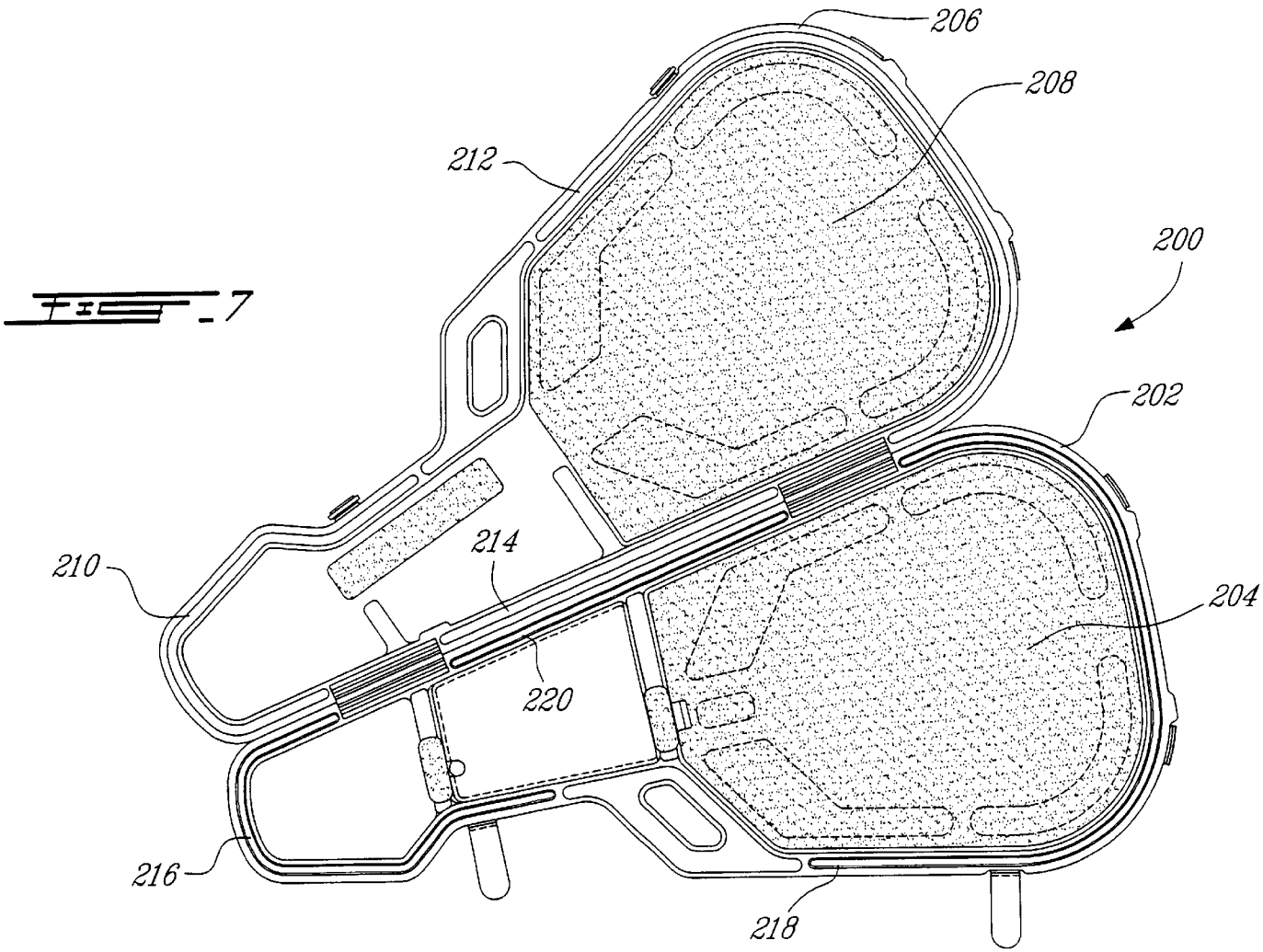
FIG. 7 is a top plan view very similar to FIG. 6 but illustrating another embodiment of a guitar case constructed according to the present invention.

Turning now to FIG. 7 of the appended drawings, a musical instrument case 200 according to a second embodiment of the present invention will be described. It is to be noted that since the case 200 is very similar to the case 20 of FIGS. 2–6, and for concision purposes, only the differences between these two cases will be described hereinbelow.

A first difference between the cases 20 and 200 is that the body 202 of the case 200 includes an optional soft fabric covering 204 to cover the soft body padding elements. Similarly, the cover 206 of the case 200 includes an optional soft fabric covering 208 to cover the soft cover padding elements.

Another difference resides in the complementary channels and tongues provided on the peripheral edges of the body 202 and cover 206. Indeed, the cover 206 includes three channels 210, 212 and 214 while the body 202 includes three complementary tongues 216, 218 and 220. The almost continuous nature of the channel and tongue further improves the structural integrity and better prevents water from entering the case when the case is carried in the rain, for example.

Finally, the case 200 does not include side padding elements of the case 20.

Even though the invention as been described by reference to a guitar case, other cases, it can be modified to create musical case suitable for other musical instruments. Of course, the number, positions and nature of the padding elements may be modified depending on the nature of the musical instrument to be carried to provide adequate protection thereof.

As will easily be understood by one skilled in the art, the body and cover of the musical instrument case of the present invention may be manufactured following injection molding procedures, blow molding procedures or vacuum molding procedures, for example.

It will also be noted by one skilled in the art that the outer surfaces of the body and cover may be textured during the molding process to improve the aesthetic of the musical instrument case.

Finally, it is to be noted that the use of a rigid foam material for the case of the present invention is advantageous since it is a light material that dissipates at least a portion the energy imparted to the case when the case is inadvertently brought into forceful contact with other objects, thereby decreasing the portion of this energy transferred to the musical instrument. Furthermore, the nature of the rigid foam material is such that the internal volume created by the body and cover is thermally insulated.

Although the present invention has been described hereinabove by way of preferred embodiments thereof, it can be modified, without departing from the spirit and nature of the subject invention as defined in the appended claims.

What is claimed is:

1. A musical instrument case comprising:

a body made of rigid foam material, said body defining an outer surface and an inner surface; and a cover made of rigid foam material, said cover being hingedly mounted to said body so as to be movable between a closed position and an open position, said cover defining an outer surface and an inner surface; said outer surfaces of said body and said cover defining an outer surface of the musical instrument case;

said cover being hingedly mounted to said body via at least one plastic material hinge; each said at least one plastic material hinge being made of an extrusion and having a double-T shape configured and sized so that one of the legs of the hinge is to be mounted in an opening of said body and the other of the legs of the at least one hinge is to be mounted in an opening of said cover; each said at least one hinge also comprising, between said legs, a thinner folding portion.

2. The musical instrument case as recited in claim 1, wherein said body is generally concave and provided with a peripheral edge and wherein said cover is generally concave and provided with a peripheral edge.

3. A The musical instrument case as recited in claim 2, wherein said peripheral edges of said body and cover are complementary.

4. A musical instrument case comprising:

a body made of rigid foam material, said body defining an outer surface and an inner surface; said body being generally concave and provided with a peripheral edge; and a cover made of rigid foam material, said cover being hingedly mounted to said body so as to be movable between a closed position and an open position, said cover defining an outer surface and an inner surface; said cover being generally concave and provided with a peripheral edge;

wherein (a) said outer surfaces of said body and said cover defining an outer surface of the musical instrument case; and one of said peripheral edge of said body and said cover includes a tongue and the other of said peripheral edge of said body and said cover includes a corresponding groove.

5. The musical instrument case as recited in claim 1, wherein both said body and case include corresponding integrally formed handle portions.

6. The musical instrument as recited in claim 5, further comprising handle reinforcing elements embedded in the foam material in the integrally formed handle portions.

7. The musical instrument case as recited in claim 1, wherein said body includes an internal compartment.

8. The musical instrument case as recited in claim 7, wherein said internal compartment is closed by an internal cover hingedly mounted to the body.

9. The musical instrument case as recited in claim 8, wherein said cover includes a projection so configured sized and positioned that it prevents the opening of said internal cover when said cover is in said closed position.

10. The musical instrument case as recited in claim 1, further comprising an external securing assembly to selectively prevent unwanted opening of said case.

11. A musical instrument case comprising:

a body made of rigid foam material, said body defining an outer surface and an inner surface;

a cover made of rigid foam material, said cover being hingedly mounted to said body so as to be movable between a closed position and an open position, said cover defining an outer surface and an inner surface; said outer surfaces of said body and said cover defining an outer surface of the musical instrument case;

said musical instrument case further comprising an external securing assembly to selectively prevent unwanted opening of said case; said securing assembly including hook and loop type strips provided on external surfaces of said body and cover.

12. The musical instrument case as recited in claim 11, wherein said securing assembly further comprises securing straps encircling both said body and cover when said cover is in said closed position.

13. A musical instrument case comprising:

a body made of rigid foam material, said body defining an outer surface and an inner surface; and a cover made of rigid foam material, said cover being hingedly mounted to said body so as to be movable between a closed position and an open position, said cover defining an outer surface and an inner surface; both said outer surfaces of said body and said cover defining an outer surface of the musical instrument case;

wherein the rigid foam material forming said body and said cover includes polypropylene foam.

14. The musical instrument case as recited in claim 1, further comprising a soft padding element mounted to at least a portion of said internal surfaces of at least one of said body and cover.

15. The musical instrument case as recited in claim 14, wherein said padding element is provided on a periphery of said internal surfaces of said body and cover, thereby allowing the instrument to be suspended in said case.

16. The musical instrument case as recited in claim 14, wherein said padding element includes a plurality of padding elements.

17. The musical case instrument as recited in claim 15, wherein at least one of said plurality of padding elements includes a multi-layered structure.

18. The musical instrument case as recited in claim 16, wherein said multi-layered structure includes a textile fabric layer.

19. The musical instrument case as recited in claim 14, further comprising a soft fabric layer mounted to said padding element.

* * * * *